US007819052B2

(12) United States Patent
Zedrosser

(10) Patent No.: US 7,819,052 B2
(45) Date of Patent: Oct. 26, 2010

(54) FIREARM WITH A CLOSING DEVICE OF OPERATIVE SIDE PORTS OF A RECEIVER

(75) Inventor: Ulrich Zedrosser, Steyr (AT)

(73) Assignee: Fabbrica D'Armi Pietro Beretta S.p.A., Gardone Val Trompia (IT)

( * ) Notice: Subject to any disclaimer, the term of this patent is extended or adjusted under 35 U.S.C. 154(b) by 158 days.

(21) Appl. No.: 12/244,991

(22) Filed: Oct. 3, 2008

(65) Prior Publication Data

US 2009/0249673 A1 Oct. 8, 2009

(30) Foreign Application Priority Data

Oct. 4, 2007 (IT) ..... MI2007A001910

(51) Int. Cl.
*F41A 3/82* (2006.01)

(52) U.S. Cl. ..... 89/199; 89/1.4

(58) Field of Classification Search ..... 89/1.4, 89/199; 42/16, 96, 85
See application file for complete search history.

(56) References Cited

U.S. PATENT DOCUMENTS 1,878,038 A * 9/1932 Von Frommer ..... 42/16
2,341,767 A * 2/1944 Gans ..... 42/25
3,757,447 A * 9/1973 Rowe ..... 42/51
3,938,271 A * 2/1976 Hyytinen ..... 42/16
5,918,401 A * 7/1999 Rowlands ..... 42/16
6,314,672 B2 * 11/2001 Murello et al. ..... 42/16
7,181,881 B2 * 2/2007 Fischbach et al. ..... 42/99
2001/0013192 A1 * 8/2001 Murello et al. ..... 42/75.02
2007/0199435 A1 * 8/2007 Hochstrate et al. ..... 42/85
2010/0000139 A1 * 1/2010 Brown ..... 42/96

* cited by examiner

*Primary Examiner*—Michael Carone
*Assistant Examiner*—Jonathan C Weber
(74) *Attorney, Agent, or Firm*—Oblon, Spivak, McClelland, Maier & Neustadt, L.L.P.

(57) ABSTRACT

A firearm includes a closing device of operative side ports of a receiver, a bolt assembly and the receiver equipped on at least one side with an operational port. The bolt assembly includes a bolt, a bolt-holder slide carrying a cocking handle and an inertial return element of the bolt-slide. The closing device includes at least one cover which is movable along a longitudinal rail from an advanced engagement position with the at least one operational side port and a withdrawn disengaged position. The inertial element includes a first spring and a second spring applied in series on the longitudinal rail. A supporting device of the at least one cover is assembled axially and slides along the longitudinal rail between the first spring and the second spring.

8 Claims, 3 Drawing Sheets

FIREARM WITH A CLOSING DEVICE OF OPERATIVE SIDE PORTS OF A RECEIVER

BACKGROUND OF THE INVENTION

I. Field of the Invention

The present invention relates to a firearm with a closing device of operative side ports of a receiver, in particular of ports situated on the right, left, or on both sides of the receiver.

II. Description of Related Art

Operative ports are suitable for allowing the movement of components protruding from the receiver, generally connected to the bolt, such as, for example, a cocking handle in repeat firearms.

The cocking handle, connected to the bolt-slide group, must be moved manually into its most withdrawn operating position at least for the loading of the first cartridge from the magazine. The cocking handle returns from its most withdrawn position together with the bolt-slide into its most advanced functional position due to the recoil springs of the bolt assembly.

On the contrary, in the case of an automatic firearm, after the first shot, the withdrawal and advance run of the bolt-slide takes place autonomously.

The run of the bolt-slide and cocking handle integral therewith varies according to the length of the cartridge. The operative openings in the receiver and their total length must consequently take these parameters into account.

In most repeat firearms, for ergonomic, mechanical and functional reasons, the cocking handle is situated close to the front end of the ejection port of the cartridge cases. In this case, the ejection port is also contemporaneously part of the operative port of the cocking handle.

As the ejection port is not sufficiently long enough to allow the run of the cocking handle, however, at a rear end of the ejection port there is generally located a slit opening in the receiver as an extension of the ejection port.

For the correct functioning of the firearm, it is important for the slit opening, and also the ejection port of the receiver, to be as closed as possible to prevent the functioning of the firearm from being unacceptably jeopardized under unfavourable environmental conditions, such as sand, dust, snow and the like. These disturbing factors could in fact be freely introduced through the port inside the firearm and in particular near the main components, such as for example, the bolt and firing pin, causing disturbances in the functioning of the firearm and at the worst damaging it.

In the case of the ejection ports, these are closed for every reloading operation by the same bolt-slide.

For the other operative ports of the cocking handle, a solution could be to lengthen the bolt-slide to allow this in its movement to also cover the slit openings. This solution however would require a lengthening of the receiver which would consequently lead to an increase in the length of the arm and therefore its weight.

For this reason, firearms of this type are generally equipped with various kinds of closing devices applied outside the receiver.

The use is known of a cover which can be moved along rails by means of the cocking handle, which, upon withdrawing, overcomes the force of a recoil spring, which is constrained to the cover. During the withdrawal of the cocking handle, it is the same cocking handle which moves the cover freeing the slit opening. When the handle is disengaged from the slit during the advance run, the recoil spring brings the cover back into its starting closure position of the opening.

In another known solution, less commonly used, two rubbery closing lips are assembled parallel to the slit openings for their whole length. When the cocking handle, in its withdrawal, enters the area of the elastic closing lips, it deforms them and moves them to complete its trajectory. When the cocking handle, in its advance run, abandons the area of the lips, these return to their original position to reclose the slit openings of the receiver.

This movement or deformation process is effected for every shot. The above-mentioned components are therefore among those which are subject to most stress and are consequently made of high-quality materials.

A first drawback of the known devices consists in their cost, the cost of the additional constraining elements, the assembly costs and also maintenance costs.

These costs are doubled above all for ambidextrous firearms.

A further disadvantage of the above devices of the known art consists in the considerable problems relating to reliability, particularly serious under critical environmental conditions in which functioning without blockages of the firearm is particularly important.

Due to sand, dirt or ice on the rails there may in fact be problems in the withdrawal of closing devices with a cover as the recoil spring may not have sufficient force. Hindrance problems however prevent the production of recoils springs having a greater force reserve.

The production of elastic lips also has problems of reliability with time, as the elasticity of the lips is reduced and they become cracked and fragile and are no longer capable of exerting their closing function.

A further drawback of the known devices described is that energy is taken from the bolt to activate the closing, thus reducing the force reserves.

BRIEF SUMMARY OF THE INVENTION

An objective of the present invention is to provide a firearm with a closing device of operative side ports of a receiver which is reliable also after prolonged use under hostile environmental conditions.

A further objective of the present invention is to provide a firearm with a closing device of operative side ports of a receiver comprising the least possible number of pieces that require a simple assembly.

Another objective of the present invention is to provide a firearm with a closing device of operative side ports of a receiver which is particularly simple and functional, with limited costs also for ambidextrous firearms.

These objectives according to the present invention are achieved by providing a firearm with a closing device of operative side ports of a receiver.

BRIEF DESCRIPTION OF THE DRAWINGS

The characteristics and advantages of a firearm with a closing device of operative side ports of a receiver according to the present invention will appear more evident from the following illustrative and non-limiting description, referring to the enclosed schematic drawings, in which.

DETAILED DESCRIPTION OF THE INVENTION

Figure 1:
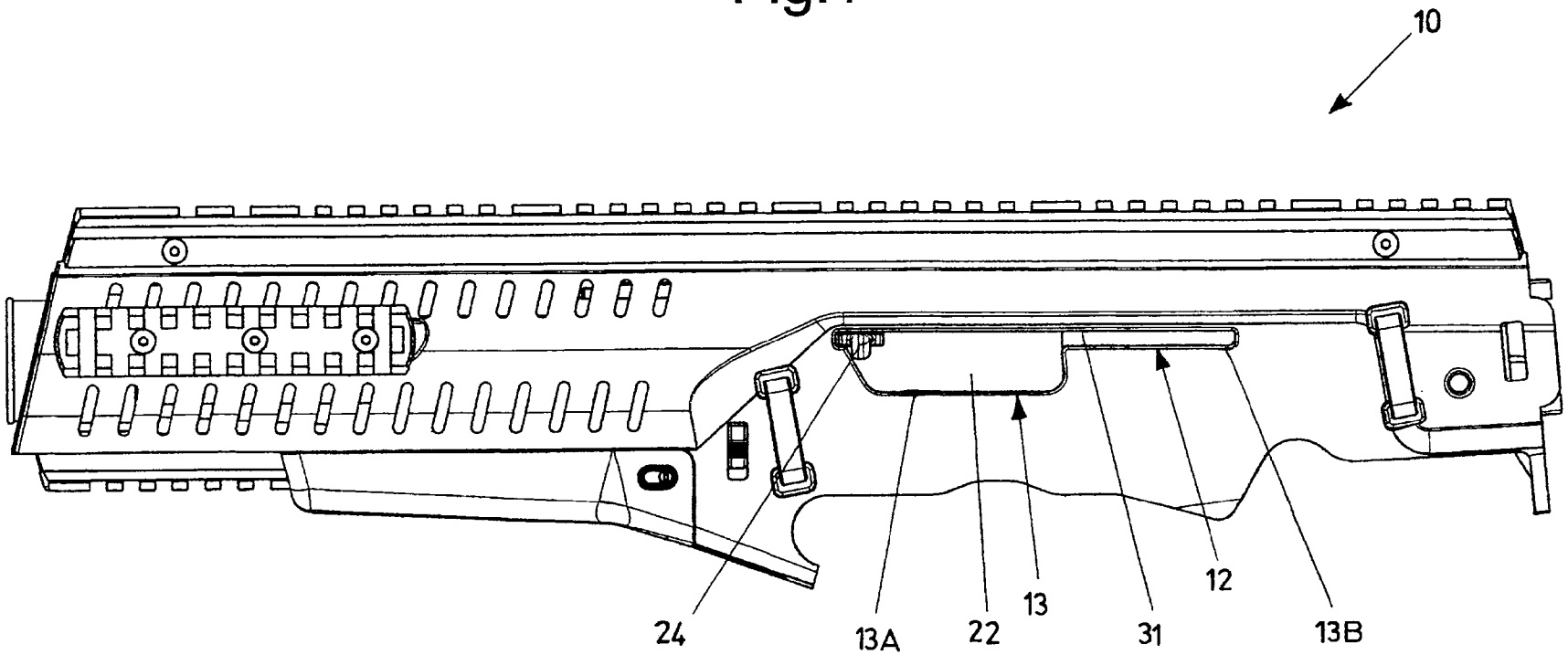
FIG. 1 is a side view of a portion of a firearm with a closing device of operative side ports of a receiver according to the present invention.
Figure 2:
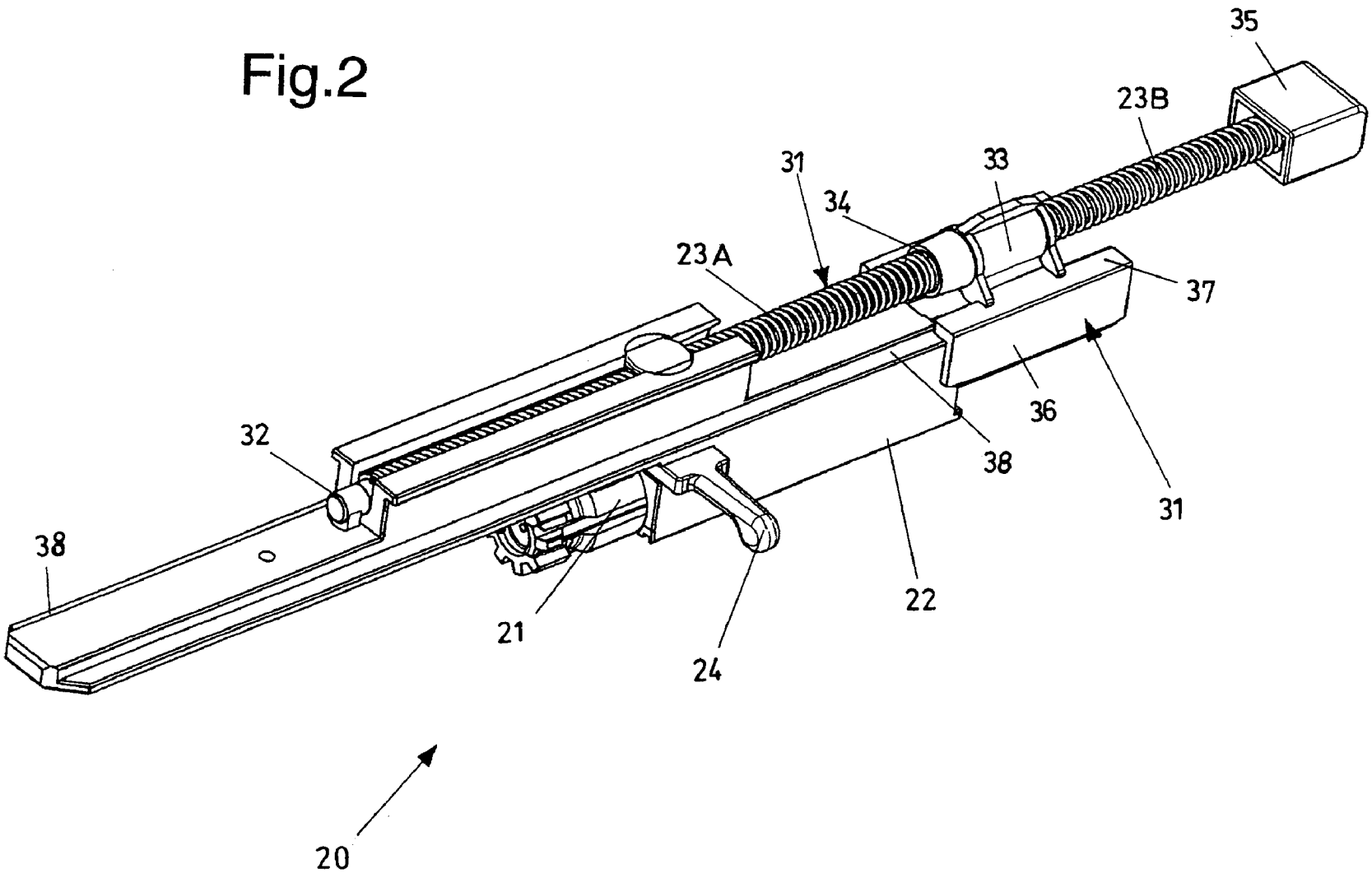
FIG. 2 is a perspective view of a closing device of operative side ports of a receiver according to the invention, applied to a bolt assembly.
Figure 4:
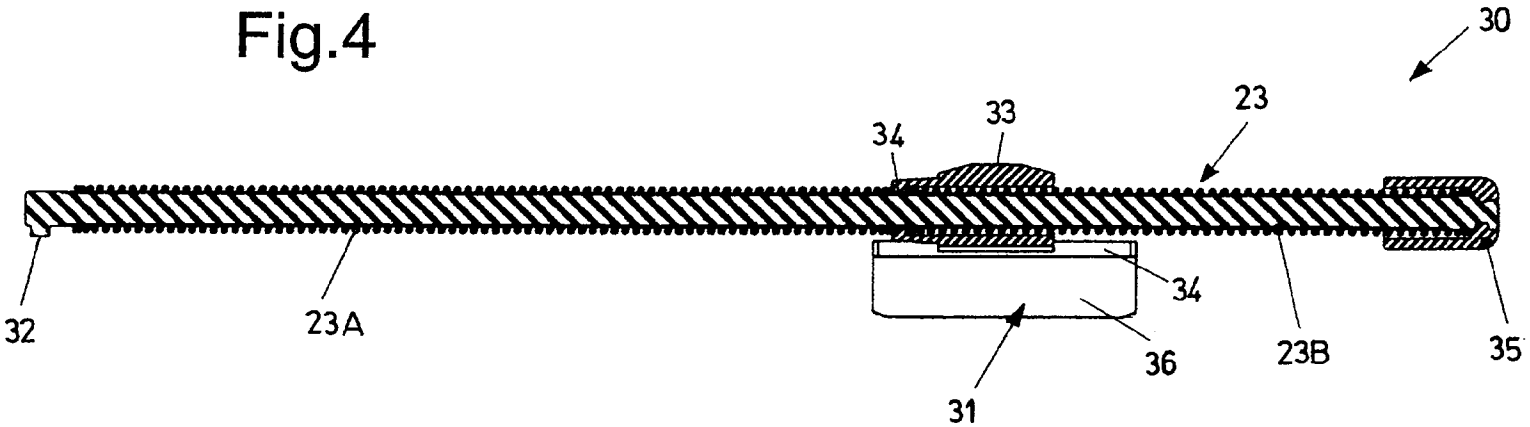
FIG. 4 is a section according to the trace IV-IV of FIG. 3.
Figure 3:
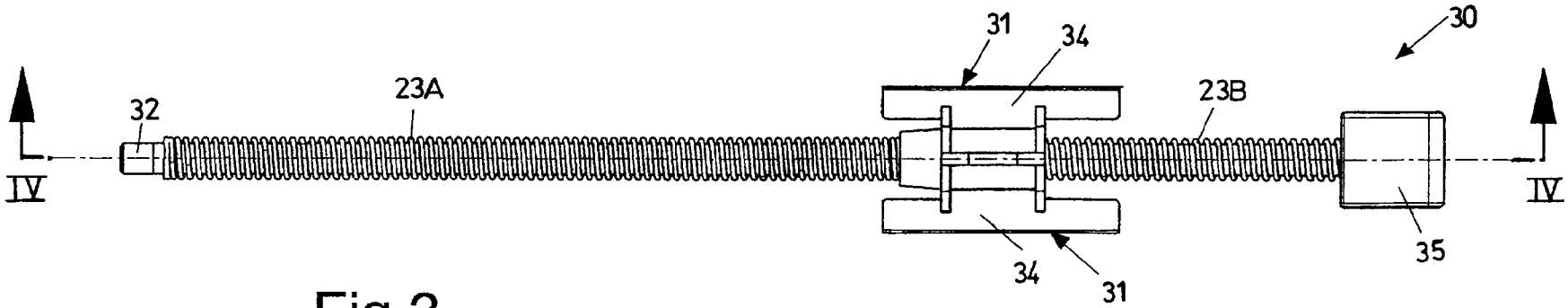
FIG. 3 is a plan view of the closing device of FIG. 2.

With reference to the figures, these show a firearm, with a closing device of operative side ports 13 of a receiver, indicated as a whole with reference numeral 10.

The firearm 10 comprises a bolt assembly 20 and a receiver 12 equipped on at least one side with an ejection port 13A for a cartridge case, not shown.

The bolt assembly 20 comprises a bolt 21, a bolt-holder slide 22 and an inertial return element 23 of the bolt-slide 22. A cocking handle 24 which, when the firearm is assembled, protrudes laterally from an opening of the receiver 12, is integrally constrained on the bolt-holder slide 22. According to the preferred embodiment, shown in the figures, the cocking handle 24 protrudes from the ejection port 13A.

The operative port 13 comprises, at the rear end of the ejection port 13A, a slit extension 13B, or slit opening, for the passage of the cocking handle 24 in the last part of its withdrawal run integral with the bolt-slide 22.

In ambidextrous arms, the receiver 12 has an ejection port 13A and a slit opening 13B as an extension thereof, symmetrically on both sides. The cocking handle 24 can be indifferently constrained to the slide 22 so as to protrude from the right or left opening.

The firearm 10 is also equipped with a closing device 30 of the operative side ports 13 of the receiver 12, i.e. of the ejection ports 13A and slit extension 13B, which comprises at least one cover 31 which can be moved along a longitudinal rail 32 from an advanced position engaged with the slit extension 13B to a withdrawn disengaged position with the same.

In the embodiment shown for illustrative purposes, the cover 31 covers the slit opening 13B, as the ejection port 13A is covered by the same bolt-slide 22. According to further embodiments, not shown, the cover 31 could also at least partly cover the ejection port 13A.

The cover 31 is situated between a first and a second spring 23A and 23B, which form the inertial element 23 of the slide 22, applied in series on the longitudinal rail 32.

The cover 31 is assembled axially and slides on the same longitudinal rail 32, which in the example shown is a guiding rod, by means of supporting devices 33, which comprise an annular portion 34 fitted on the guiding rod 32 between the first spring 23A and second spring 23B.

The springs 23A and 23B are respectively in contact with their free ends on the slide 22 and on a stop 35 constrained to the rear end of the longitudinal rail 32.

The two springs 23A and 23B preferably have different lengths for controlling the cover run.

The cover 31, which can be made of a polymeric material, has, for example, an overturned "L"-shaped section, comprising a larger vertical side 36 for the closing of the slit 14 and a smaller horizontal side 37 suitable for running in a complementary longitudinal seat 38 situated along a corresponding upper edge of the slide 22.

In the particular case of a symmetrical receiver 12, i.e. with operative ports on both sides, the closing device 30 comprises a cover 31 for each side, constrained by supporting means 33. According to this embodiment, the slide 22 is equipped on both sides with longitudinal seats 38.

The movement control of the cover 31 for the opening and closing is effected by means of two springs 23A and 23B of the bolt.

The withdrawal of the slide 22 in the firing phases, in fact, compresses the springs 23A and 23B which entrain the cover 31 towards the rear end of the firearm. The withdrawal run of the cover 31 frees the slit openings 13B to allow the travel of the cocking handle 24.

At the end of each shot, the two springs 23A and 23B bring the bolt assembly 20 back to the advanced position due to inertia. In their movement along the guiding rod 32 they consequently also bring the cover 31 back to its advance closing position of the slit openings 13B.

The firearm with a closing device of the operative ports of a receiver, object of the present invention, has the advantage of requiring only one additional component with respect to known firearms, i.e. the cover.

Furthermore, the opening and closing of the slit opening of the receiver takes place without the cover coming into contact with other components. The control of the opening and closing movement of the cover, in fact, takes place without any impact or blows through the two springs of the bolt.

A further advantage lies in the fact that there are no additional assembly costs and the cover can be made of an economical polymeric material.

Furthermore, in the case of an ambidextrous firearm, it is sufficient to produce a symmetrical cover without any particular additional costs.

Finally, the springs of the bolt guarantee a completely reliable functioning of the device. To the extent in which the springs bring the bolt back to the advanced position, they also bring the cover back to its advanced closing position of the slit openings in an equally reliable manner.

The firearm with a closing device of operative side ports of a receiver thus conceived can undergo numerous modifications and variants, all included in the invention; furthermore, all the details can be substituted by technically equivalent elements. In practice, the materials used, as also the dimensions, can vary according to technical requirements.

The invention claimed is:

1. A firearm with a closing device of operational side ports of a receiver, the firearm comprising:

a bolt assembly; and a receiver equipped on at least one side thereof with at least one operational side port, wherein said bolt assembly includes a bolt, a bolt-holder slide carrying a cocking handle, and an inertial return element of the bolt-slide, wherein said closing device includes at least one cover which is movable along a longitudinal rail from an advanced engagement position with said at least one operational side port to a withdrawn disengaged position, wherein said inertial element includes a first spring and a second spring disposed in series on said longitudinal rail, and wherein supporting means of said at least one cover are assembled axially and slide along said longitudinal rail between said first spring and said second spring.

2. The firearm according to claim 1, wherein said first spring and said second spring have different lengths for controlling a cover run of said at least one cover.

3. The firearm according to claim 1, that wherein said first spring and said second spring are respectively in contact with their free ends thereof on said bolt-holder slide and on a stop, constrained to a rear end of said longitudinal rail.

4. The firearm according to claim 1, wherein said supporting means include an annular portion fitted on said longitudinal rail between said first spring and said second spring.

5. The firearm according to claim 1, wherein said operational side ports include an ejection port for a cartridge case and, at a rear of the operational side ports, a slit extension for passage of said cocking handle in a last part of a withdrawal run thereof, said cover having a length substantially equal to a length of said slit extension.

6. The firearm according to claim 1, wherein said at least one cover has an overturned "L"-shaped section and includes a larger vertical side for closing of said operational side ports and a smaller horizontal side for running in a complementary longitudinal seat situated along a corresponding upper edge of said slide.

7. The firearm according to claim 1, wherein said at least one cover is made of a polymeric material.

8. The firearm according to claim 1, wherein said receiver includes said operational ports symmetrically on opposite sides thereof, said closing device including a cover for each side of said receiver.

* * * * *